United States Patent [19]

Perrier de la Bathie et al.

[11] Patent Number: 4,610,017

[45] Date of Patent: Sep. 2, 1986

[54] HIGH FREQUENCY INDUCTION MELTING FURNACE AND PROCESS FOR THE PRODUCTION OF CERAMIC MATERIALS USING THIS FURNACE

[75] Inventors: Rene Perrier de la Bathie, St. Pierre d'Albigny; Jacques Terrier, Grenoble, both of France

[73] Assignee: Commissariat a l'Energie Atomique, Paris, France

[21] Appl. No.: 580,133

[22] Filed: Feb. 14, 1984

[30] Foreign Application Priority Data

Feb. 14, 1983 [FR] France ..... 83 02328

[51] Int. Cl.[4] ..... H05B 5/16

[52] U.S. Cl. ..... 373/156; 373/152; 373/155

[58] Field of Search ..... 373/151, 152, 153, 156, 373/157, 142, 158, 159, 160, 161, 162, 163, 164, 165, 166; 219/10.49 R, 10.79, 10.75, 10.65; 75/12; 65/128, 134, 135

[56] References Cited

U.S. PATENT DOCUMENTS

| | | | |
|---|---|---|---|
| 4,338,112 | 7/1982 | Propster | 65/134 |
| 4,436,551 | 3/1984 | Mori | 75/12 |
| 4,471,488 | 9/1984 | Reboux | 373/153 |

FOREIGN PATENT DOCUMENTS 1430192 of 0000 France .

*Primary Examiner*—Roy N. Envall, Jr.
*Attorney, Agent, or Firm*—James E. Nilles

[57] ABSTRACT

Process for the production of ceramic materials by high frequency induction melting.

The powder containing the various components of the material to be prepared is introduced in a continuous manner into an aperiodic high frequency electric furnace, whose single flat coil serves both as the induction system and the cold crucible, the molten material also being continuously removed from the furnace in a chute passing through the coil.

3 Claims, 3 Drawing Figures

HIGH FREQUENCY INDUCTION MELTING FURNACE AND PROCESS FOR THE PRODUCTION OF CERAMIC MATERIALS USING THIS FURNACE

BACKGROUND OF THE INVENTION

The present invention relates to the production of ceramic materials or glass by high frequency induction melting in a furnace, on whose walls form an insulating crust or autocrucible.

In general terms, it is known that ceramic oxides, which are good electrical insulants at ambient temperature, have a resistivity $\rho$ which decreases with increasing temperature (approximately 0.1 to 10 Ohm.cm at around their liquefaction temperature).

It is therefore possible to maintain these materials in the molten state by induction heating at a high frequency, e.g. approximately 100 to 500 KHz, provided that the materials are previously raised to an adequate temperature for bringing about their liquefaction and that the furnace is given the necessary minimum dimensions for obtaining a correct electric induction heating throughout the molten mass.

In the known processes of this type, the materials to be melted are generally placed in a good heat-conducting (generally copper) pot or crucible, whose walls are cooled by a circulation of water and externally surrounded by a helical coil through which passes the high frequency inducing current bringing about the heating of the central mass contained in the pot by electromagnetic induction. Due to the powerful cooling of the cylindrical copper walls forming the pot, a crust or skin forms internally against said wall and brings about a thermal and electrical insulation of the hot liquid part located within the crust and where all the induced energy is given off. In the known equipment of this type, it is necessary to work with conventional high frequency generators and also in an intermittent manner, i.e. for each operation the pot must be filled with powder containing the different components of the material to be produced, followed by induction heating, emptying its liquid phase and cleaning before the following operation.

Moreover, the fact that the inducing helical coil is separate from the copper crucible leads to a significant high frequency power loss (approximately 50%) and the discontinuous nature of the production leads to a by no means negligible energy consumption due to the successive preheatings of the material obtained either by introducing good electricity-conducting products into the mass, or by direct heating with external means, such as e.g. combustion gases.

Consideration has therefore been given to the improvement of the energy utilization of such induction furnaces by forming the wall of the crucible by the actual primary inductor and the secondary of the thus formed electrical transformer is constituted by the molten material mass, within which induced currents develop.

This applies with respect to the electric furnace described in French Pat. No. 1,430,192, which essentially comprises a cylindrical metal wall, slotted along a generatrix and sealed by an insulating joint 2 (FIG. 2) made from a sufficiently refractory material for the metal wall to form a single turn coil connected on either side of joint 2 to two poles of a high frequency power supply.

However, a furnace of this type suffers from two serious disadvantages. Firstly, the slot made in the cylinder constituting the furnace wall produces a high magnetic field gradient, which is prejudicial to the homogeneity of the inductive heating. Secondly, the single turn coil formed in this way can only be supplied by the high frequency generator across an air-core transformer, which leads to a significant energy loss and to a correlative reduction in the efficiency of the installation.

SUMMARY OF THE INVENTION

The present invention specifically relates to an induction melting furnace having a simple construction and making it possible to overcome the aforementioned disadvantages.

This furnace, whose wall constitutes both the inductor, the cold crucible for maintaining the product molten and the choke of the oscillating circuit of the high frequency aperiodic generator is characterized in that its cylindrical wall is cut out along a generally helical line, thus forming a single flat coil with several turns.

The possibility of directly supplying such a furnace by means of an aperiodic generator without interposing an air-core transformer, as well as the almost perfect homogeneity of the high frequency field induced in the mass to be melted, makes it possible to work continuously particularly in the production of very refractory ceramic materials with a high energy utilization.

The present invention also relates to a process for producing ceramic materials which, whilst being particularly simple to carry out, makes it possible to continuously produce such ceramic materials, whilst considerably reducing the energy costs involved therein.

Thus, the invention also relates to a process for the production of ceramic materials by high frequency induction melting in a furnace on whose walls form an insulating crust or autocrucible, wherein the powder containing the various components of the material to be produced is continuously introduced into an aperiodic high frequency electric furnace, whereof the single flat helical coil serves both as the induction system and as the cold crucible, the molten material obtained also being continuously removed from said furnace into a chute passing through the coil.

Thus, according to the invention, two essential features are simultaneously utilized and lead to the obtaining of the aforementioned advantages. The first feature is the use of an aperiodic electric furnace, i.e. containing no separate oscillating circuit and having no natural operating frequency, the latter being chosen by the inductor which automatically determines it by electromagnetic coupling of the product to be melted. According to the second feature, the furnace is produced by the helical winding of a single flat coil serving both as the induction system and as the cold crucible, thus eliminating the energy losses inherent in the prior art when using furnaces in which the crucible is independent of the inducing coil. In an aperiodic generator according to the invention, it is the combination of the helically wound flat coil and material to be treated which constitute the crucible, the induction system and the choke of the oscillating circuit, the system automatically balancing itself by being in electrical resonance as a result of the automatic choice of the operating frequency.

According to an important feature of the process according to the invention, the molten material is removed and the powder containing the various components is supplied to the upper part of the furnace, in the vicinity of the free surface of the molten material, the homogenization of the mixture of the powders and the ceramic materials being carried out by electromagnetic stirring of the liquid phase.

One of the advantages of the process according to the invention is that the induction heating causes within the actual molten material convection currents which are sufficient to ensure the homogenization of the powder mixtures and the molten ceramic material, thus permitting both the supply of solid powder and the removal of the molten material at the surface of the liquid phase contained in the furnace.

According to another secondary, but interesting feature of the invention, the furnace is filled during the first charging with the aid of two materials provisionally separated by a cylindrical wall, namely between said wall and the furnace wall a first material which will form the autocrucible, and within the actual cylindrical wall a second material which will be melted.

The cylindrical part separating the two materials at the time of charging can be removed when filling is completed or, a fortiori, when the furnace has reached its normal melting temperature.

Finally, the start of melting of a ceramic material can take place either in the conventional manner by heating with gases, or by placing an e.g. circular conductive plate into the material to be melted and which is positioned in the centre of the crucible, kept stationary and energized during the necessary time by means of a high frequency current.

In order to minimize heat losses in the bottom of the furnace, it is advantageous to constitute it e.g. by a copper plate, which is cooled by a circulation of water, or by a refractory material plate.

By maintaining the quantity of liquid enamels constant in the induction furnace, there is no need for the successive preheatings required in the prior art for initiating induction in these materials.

The continuous outflow of the liquid enamels at the free surface of the liquid phase is brought about by means of an insulated or uninsulated, cooled chute passing through the inducing coil.

Thus, without seeking to especially optimize the process with the aid e.g. of infrared radiation reflectors located above the surface or by localized heating above the chute, it has been possible to obtain energy production efficiencies two to five times higher than those of the prior art. The average consumption is 2 kWh/kg of material produced. It is therefore lower than the consumption required for the production of the same products in gas furnaces and the energy costs are approximately 30% lower.

Thus, the process according to the invention makes it possible to obtain a very efficient energy utilization, a continuous casting by automatically regulated overflow, and the minimization of the preheating means in an installation able to operate continuously for several days without starting and stopping.

The process according to the invention has numerous applications in the production of enamels and glasses for ceramic materials, as well as in the vitrification of nuclear waste.

BRIEF DESCRIPTION OF THE DRAWINGS

The invention is described hereinafter relative to non-limitative embodiments and with reference to the attached drawings, wherein show.

DETAILED DESCRIPTION OF THE INVENTION

Figure 1:
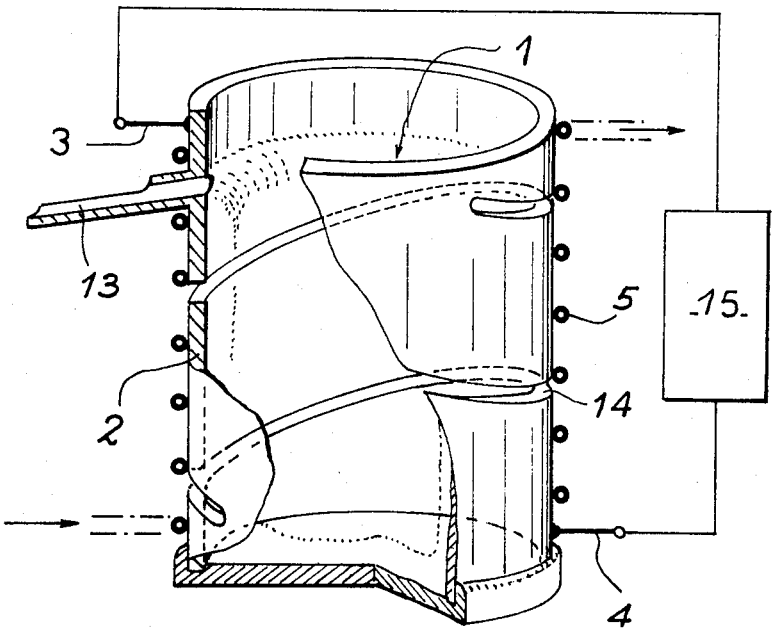
FIG. 1 in diagrammatic section along the axis, an embodiment of a high frequency aperiodic furnace according to the invention.

FIG. 1 shows in the form of an exploded view, the formation of the crucible 1 of the furnace with the aid of a helical winding of a flat conductive strip 2 along a cylindrical surface. The furnace construction, which is a characteristic of the invention, is obtained by laterally cutting out the conductive metal cylinder forming the crucible along a slot 14 having a substantially helical outline, so as to form a single flat coil having several turns. The means has two terminals 3, 4 for supplying high frequency current from aperiodic generator 15. Thus, the single coil having a number of turns resulting from the winding of strip 2 forms at the same time the crucible for melting the materials to be produced. Obviously, an arrangement of this type requires autocrucible operation, i.e. the formation of a solid crust or skin of sealing material along the inner wall of the crucible in order to ensure the sealing of the latter. Thus, a coil member 5 traversed by cold water maintains the coil and the area immediately around it at a sufficiently low temperature to form this insulating crust.

Figure 2:
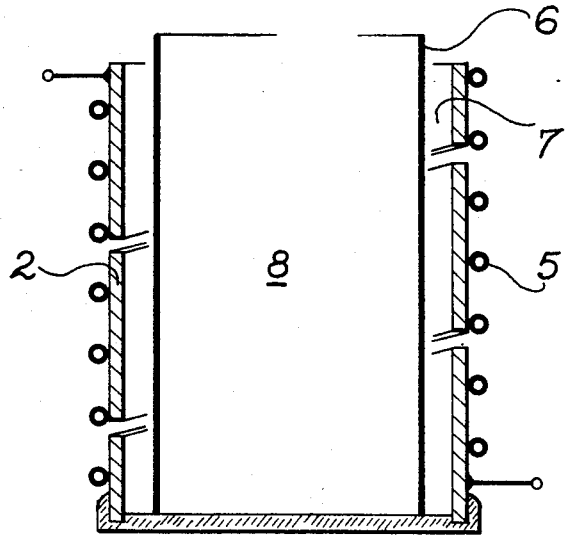
FIG. 2 in section an embodiment of an induction furnace, equipped with a cylindrical partition installed on a temporary basis at the time of the initial charging.

In the case of FIG. 2, where it is once again possible to see crucible 2, it is possible to see an inner cylindrical wall 6 within the latter, which, at the time of the initial charging, provisionally separates the peripheral material contained in zone 7, between crucible 2 and cylindrical wall 6, which is to form the insulating crust (e.g. of silica $SiO_2$) from the interior 8 of the crucible in which is placed the materials to be melted by induction heating such as e.g. silicates. The cylindrical wall 6 is only used at the time of the initial charging of the crucible 2 and is removed when the crust has formed and the melting of the materials has started.

Figure 3:
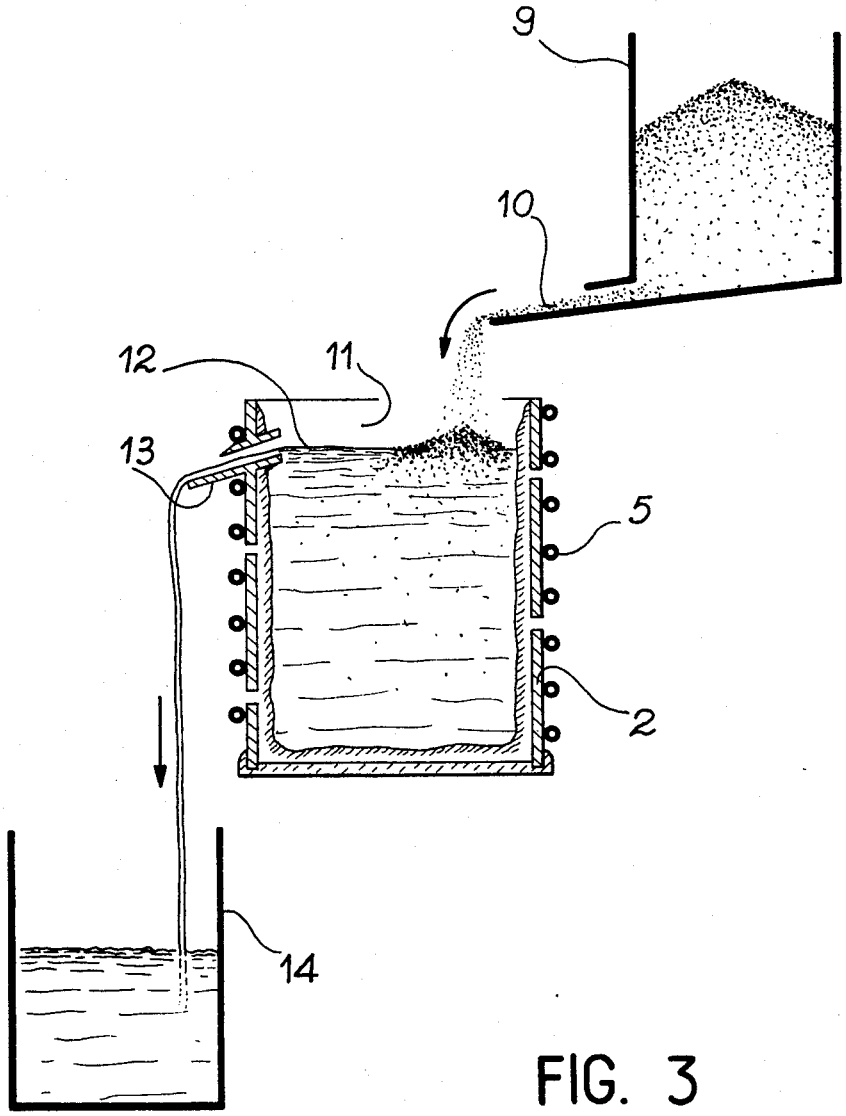
FIG. 3 diagrammatically, an installation for the continuous production of enamels according to the process of the invention.

In the installation of FIG. 3, there are successively three superimposed containers, namely a hopper 9 for supplying the powder mixture containing the different components of the materials to be produced, said powder being continuously poured by means of a chute 10 into the actual induction furnace 11, which is constructed in accordance with FIG. 1.

The molten enamels contained in furnace 11 are removed at the surface 12 for the separation of the liquid phase with the aid of chute 13, which is optionally also cooled and which passes through the coil 2 of furnace 11.

The molten enamels then flow in a conventional manner through chute 13 into a water tank 14, where they undergo the tempering necessary for their cooling and bringing into the desired shape.

For example, the following mixture was introduced into the supply hopper:

silica 327 kg
borax 61 kg
minium 500 kg
zirconia 14 kg
Potassium nitrate 18 kg
Sodium carbonate 33 kg Sodium nitrate 47 kg The furnace was supplied with 40 kg of this mixture every hour. The power used was 50 kW, the frequency 350 KHz and the production temperature 1450° C.

In the present case, 1 kWh is used per kg of product, which is about one third of the level encountered in the prior art processes.

The following performance levels were reached in an example. 10 kg of zirconium silicate ($SiZrO_4$) were melted at 2600° C. To maintain melting with a surface exposed to the free air, a power of 28 kW was used, with surface radiation losses estimated at 15 kW. 20 kWh were required for melting the complete mass, which represents a consumption of 2 kWh/kg.

What is claimed is:

1. A high frequency induction melting furnace for maintaining material in a molten state by induction from an alternating current circuit, said furnace comprising: a crucible having a substantially cylindrical wall having inner and outer sides, said crucible comprising a conductive strip having an inner surface and an outer surface and extending lengthwise helically in a plurality of turns, with successive turns spaced from one another to define a cut that extends helically from one axial end of said wall to the other, said conductive strip thus constituting a single coil having a plurality of turns, said outer surface of said conductive strip defining a portion of said outer side of said cylindrical wall; said crucible further comprising a portion of said material which is solidified and disposed in said cut and defining another portion of said outer side of said cylindrical wall; means connecting the opposite ends of said strip in an alternating current circuit wherein said coil comprised of said strip, in cooperation with molten material within said crucible, provides reactance that determines the frequency of alternating current in said circuit; and means on said outer side of said wall for conducting heat away from said outer side of said wall so that said material disposed in said cut remains solidified and prevents molten material from escaping from said crucible through said cut.

2. The high frequency induction melting furnace of claim 1 wherein said means for conducting heat away from said wall comprises a helical tube, wherein said furnace further comprises inflow means for continuously introducing material to be processed, in substantially powder form, into said crucible near one side thereof and from a level above the crucible; and wherein said crucible has an overflow outlet at the opposite side thereof and extending between adjacent turns of said helical tube and from which molten material is displaced by material entering the crucible at said inflow means.

3. The high frequency induction melting furnace of claim 1 further comprising a removable substantially cylindrical partition member in said crucible, substantially concentric to said cylindrical wall, having an outside diameter smaller than the inside diameter of said cylindrical wall to cooperate with the latter to define an annular chamber wherein material in said cut can solidify, said partition member being removable so that it does not interfere with operation of said furnace.

* * * * *